US008616190B2

(12) United States Patent
Tadokoro et al.

(10) Patent No.: US 8,616,190 B2
(45) Date of Patent: Dec. 31, 2013

(54) CUTTER

(75) Inventors: Naoki Tadokoro, Hitachinaka (JP); Toshihiko Tachibana, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 900 days.

(21) Appl. No.: 12/530,916

(22) PCT Filed: Sep. 12, 2008

(86) PCT No.: PCT/JP2008/066921

§ 371 (c)(1),
(2), (4) Date: Sep. 11, 2009

(87) PCT Pub. No.: WO2009/035153

PCT Pub. Date: Mar. 19, 2009

(65) Prior Publication Data

US 2010/0147278 A1 Jun. 17, 2010

(30) Foreign Application Priority Data

Sep. 14, 2007 (JP) ..... 2007-240192

(51) Int. Cl.
*B28D 7/02* (2006.01)

(52) U.S. Cl.
USPC ..... 125/13.01; 451/358; 451/455

(58) Field of Classification Search
USPC ..... 125/13.01; 451/455, 358
See application file for complete search history.

(56) References Cited

U.S. PATENT DOCUMENTS 1,873,152 A * 8/1932 Plantinga ..... 451/19
2,429,752 A * 10/1947 Greulach ..... 451/510
2,455,113 A * 11/1948 Coates ..... 125/13.03
2,648,239 A * 8/1953 Bechler ..... 451/455
2,948,088 A * 8/1960 Jepson ..... 451/340
4,022,182 A 5/1977 Lenkevich
4,080,952 A * 3/1978 Wain ..... 125/13.01
4,236,356 A * 12/1980 Ward ..... 451/352
4,676,557 A * 6/1987 Shope et al. ..... 125/28
6,155,246 A * 12/2000 Yamami et al. ..... 125/13.01
7,080,851 B2 * 7/2006 Schipper ..... 451/344
7,905,223 B2 * 3/2011 von Siegroth et al. ..... 125/13.01
8,215,295 B2 * 7/2012 Donnerdal et al. ..... 125/13.01
2008/0233847 A1 * 9/2008 von Siegroth et al. ..... 451/344
2010/0144251 A1 * 6/2010 Farrell ..... 451/358

FOREIGN PATENT DOCUMENTS

EP 1 707 328 A1 10/2006
WO WO 00/05032 A1 2/2000

OTHER PUBLICATIONS

Examination Report for European Patent Office application EP08830305.2 (Oct. 18, 2011).

* cited by examiner

*Primary Examiner* — Maurina Rachuba
(74) *Attorney, Agent, or Firm* — Kilpatrick Townsend & Stockton LLP

(57) ABSTRACT

A cutter for cutting a workpiece while using a water includes a housing, an electric motor disposed in the housing, a rotation shaft, a base, and a splashboard. The rotation shaft is supported by the housing for rotatably supporting an end tool driven by the electric motor. The base supports the housing, and has a top surface and a bottom surface to be in contact with the workpiece. The end tool has a part protrudable from the bottom surface. The splashboard section is positioned on the top surface and behind the end tool in a cutting direction. The splashboard section protrudes in a direction away from the top surface and extends in a direction substantially parallel to an axial direction of the rotation shaft.

5 Claims, 6 Drawing Sheets

PRIOR ART

CUTTER

CROSS REFERENCE TO RELATED APPLICATIONS

This application is a National Stage of International Application No. PCT/JP2008/066921 filed Sep. 12, 2008 and which claims the benefit of Japanese Patent Application No. 2007-240192, the disclosures of all applications being incorporated herein by reference.

TECHNICAL FIELD

The present invention relates to a cutter, and more particularly, an electrically powered cutter while using liquid such as water for cutting a workpiece.

BACKGROUND ART

A conventional cutter such as an electrical stone cutter is shown in FIGS. 11 and 12. The cutter includes a main body 51 provided with a motor 53 and an end tool 52 such as a circular blade driven by the motor 53 for cutting a workpiece such as a concrete.

A housing 54 and a gear cover 55 serve as outer frame of the main body 51. The motor 53 having a motor shaft is installed in the housing 54, and a fan 56 is also installed in the housing 54 coaxially with the motor shaft for cooling the motor 53. A gear portion 57 is installed in the gear cover 55 for deceleratingly transmitting the rotation of the motor shaft to a rotation shaft 58 of the end tool 52.

A base 59 is disposed below the main body 51 and is configured to allow the end tool 52 to protrude from a lower surface of the base 59. The main body 51 is pivotally movable about a pivot shaft 63 with respect to the base 59. An arcuate shaped link 60 extends generally vertically from the base 59 in order to adjust a cutting depth of the end tool 52 with respect to the workpiece (not shown). Liquid such as water is supplied to or adjacent to the end tool 52 in order to improve cutting efficiency with respect to the workpiece such as a stone, and to suppress generation of dust as a result of cutting. Such conventional cutter is described in Japanese Patent Application Kokai No. H07-171822.

However, in such conventional cutter, water may fly rearward in the cutting direction due to the rotation of the end tool 52 and rotation of the fan 56, if water is used during cutting. The scattered water may pass through a gap between the base 59 and main body 51 and impinge on a worker using the cutter or working behind the cutter in the cutting direction. Further, an air discharge port is formed for discharging cooling air from the fan 56. Water may also be directed rearward toward the worker due to the air blowing through the air discharge port. This causes lowering of workability.

DISCLOSURE OF INVENTION

It is therefore an object of the present invention to provide a cutter capable of providing a desirable workability.

This and other objects of the present invention will be attained by a cutter for cutting a workpiece while using a water including a housing, an electric motor, a rotation shaft, a base, and a splashboard section. The electric motor is disposed in the housing. The rotation shaft is supported by the housing for rotatably supporting an end tool driven by the electric motor. The base supports the housing, and has a top surface and a bottom surface to be in contact with the workpiece. The end tool has a part protrudable from the bottom surface. The splashboard section is positioned on the top surface and behind the end tool in the cutting direction. The splashboard section protrudes in a direction away from the top surface and extends in a direction substantially parallel to an axial direction of the rotation shaft.

With this arrangement, liquid adhered to the end tool is splashed rearward in the cutting direction due to the rotation of the end tool. However, the splashed liquid is impinged on the splashboard section, so that unwanted splashing of the liquid in a rearward direction from the splashboard section can be prevented.

Preferably, a fan is disposed in the housing and is rotatably driven by the electric motor for cooling the electric motor. The housing is formed with an air discharge port open to an atmosphere for discharging an air flowing in the housing to the atmosphere. The splashboard section is positioned rearward of the air discharge port in the cutting direction, and has a part aligned with the air discharge port in the cutting direction.

If liquid remains on the base, the liquid may be splashed rearward in the cutting direction by the air blowing from the air discharge port. However, since such splashed liquid can be impinged on the splashboard section, unwanted splashing of the liquid in a rearward direction from the splashboard section can be prevented.

Preferably, the housing has a front end portion in the cutting direction pivotally movably connected to the base, and has a rear end portion in the cutting direction, and the end tool is a circular blade. The cutter further includes a link extending from the upper surface of the base. The rear end portion of the housing is releasably fixable to the link to maintain a pivot posture of the housing. With this arrangement, cutting depth can be changed.

Preferably, the splashboard section is integral with the link. The link and the splashboard section can be attached simultaneously to the base. Thus, manufacture of the cutter can be simplified. Further, only the link should be changed with a new link in case of the replacement of the splashboard section with a new splashboard section.

Preferably, the splashboard section is inclined toward the circular blade so that a tip end of the splashboard section is positioned closer to the circular blade than its base end to the circular blade. With this arrangement, liquid impinged on the splashboard section cannot be moved rearward of the splashboard section in comparison with a case where the splashboard section protrudes in a direction perpendicular to the base.

Alternatively, the splashboard section has a base end portion protruding in a direction perpendicular to the base, and a free end portion bent from the base end portion and oriented toward the circular blade.

Alternatively, the splashboard section is positioned at a rearmost end portion of the base in the cutting direction, and the splashboard section is fixed to the base by welding and is separate from the link. In this case, the splashboard section has a height greater than a height of the link.

Alternatively, the splashboard section is made from an elastic material, and has one end fixed to the top surface of the base, and another end fixed to the housing. With this arrangement, the splashboard section can provide buffering function because of its elasticity or flexibility. Further, such splashboard section can expand or shrink because of this elasticity during pivotal movement of the housing. Therefore, unwanted liquid splashing can be avoided.

Preferably, a liquid ejection unit is provided. The liquid ejection unit has a liquid inlet and a liquid outlet for ejecting liquid toward one of the circular blade and the workpiece.

With this arrangement, cutting operation can be performed with simultaneous supply of liquid to one of the circular blade and the workpiece. Thus, cutting operation can be improved.

DESCRIPTION OF REFERENCE NUMERALS

Figure 1:
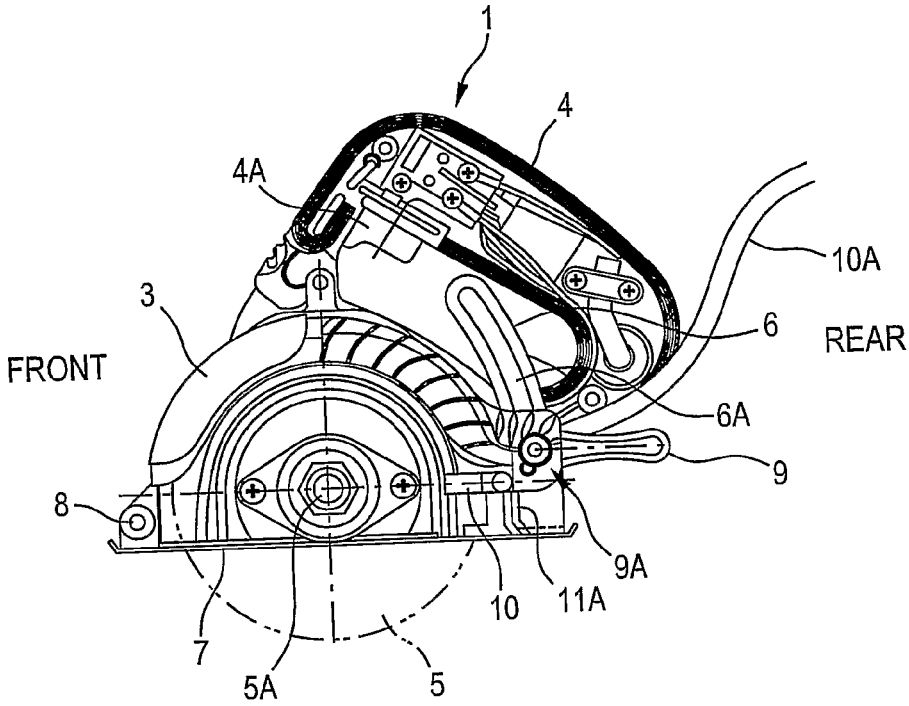
FIG. 1 is a front view of an electrically powered cutter according to a first embodiment of the present invention.
Figure 2:
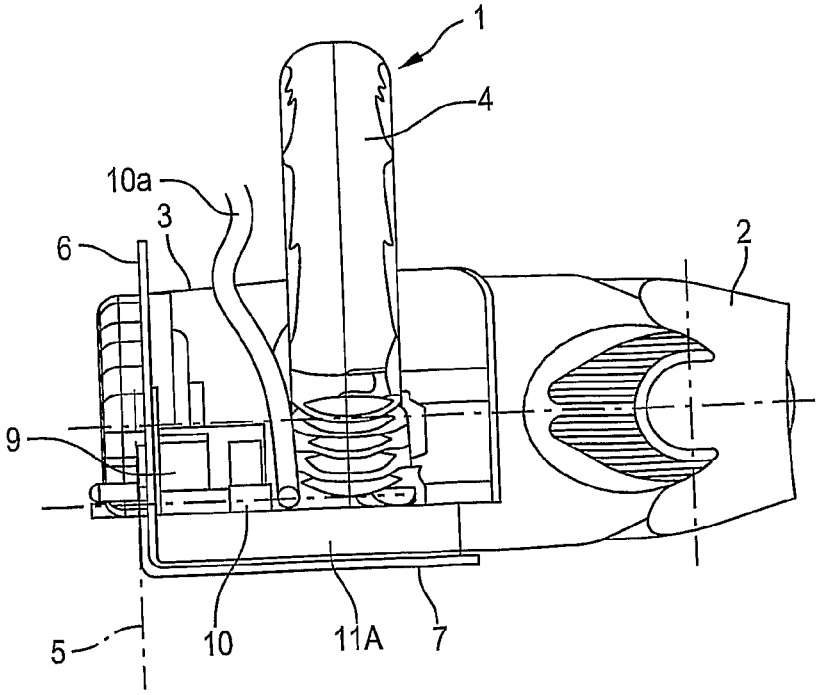
FIG. 2 is a right side view of the electrically powered cutter according to the first embodiment.
Figure 3:
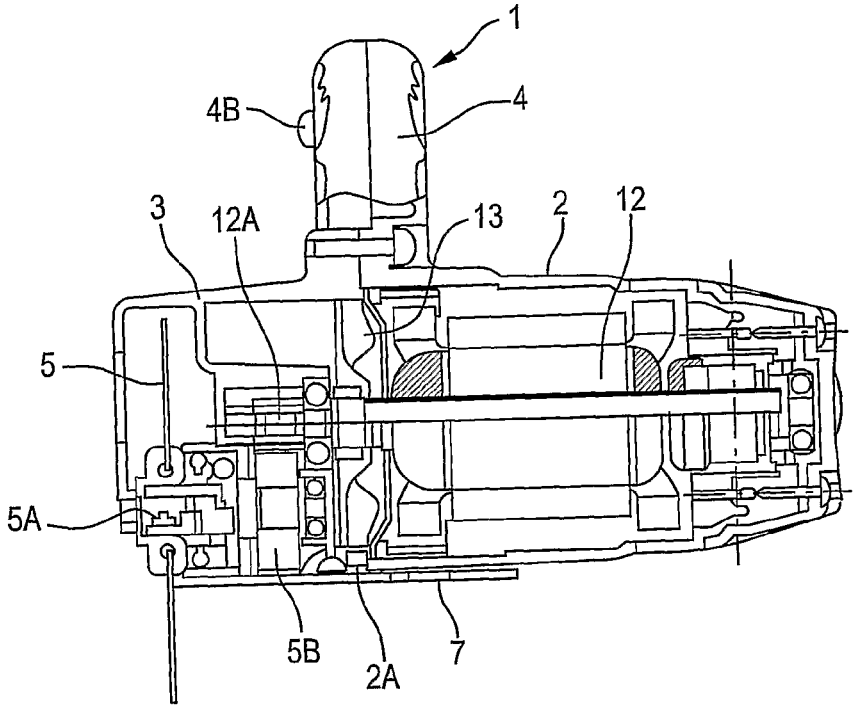
FIG. 3 is a right side view with showing an internal arrangement according to the first embodiment.

1 main body
2 housing
3 gear cover
4 handle
5 circular blade
6 link
7 base
8 pivot shaft
9 position regulation portion
10 peacock
11A,11B,11C,11D,11E splashboard section
12 motor
13 fan

BEST MODE FOR CARRYING OUT THE INVENTION

A cutter according to a first embodiment of the present invention will be described with reference to FIGS. 1 through 6. The first embodiment pertains to an electrically powered stone cutter. The cutter includes a main body 1, a base 7 and a link 6. The main body 1 is supported to the base 7, and the link 6 is provided on the base 7.

The main body 1 includes a housing 2, a gear cover 3 connected to the housing 2, and a handle 4 provided integrally with the housing 2. A motor 12 having a motor shaft 12A is accommodated in the housing 2, and a fan 13 is fixedly mounted on the motor shaft 12A for cooling the motor 12. The motor shaft 12A is fixed with a gear. An air inlet port (not shown) is formed at a side wall of the housing 2 (right side wall in FIG. 3) for introducing air into the housing 2, and air discharge port 2A is formed at the housing 2 for discharging fan air therethrough.

In the gear cover 3, a gear transmission mechanism including a gear 5B is provided. The gear transmission mechanism is in meshing engagement with the gear on the motor shaft 12A. An end tool 5 such as a circular blade 5 is detachably fixed to a rotation shaft 5A rotatably supported to the gear cover 3. The gear 5B is coaxial with the rotation shaft 5A. Upon rotation of the motor 12, the rotation shaft 5A is decelerratingly rotated through the gear transmission mechanism to rotate the circular blade 5.

The handle 4 is provided integrally with the housing 2. A switch 4A is provided on the handle 2 for turning ON the motor 12. Further, a ON-lock switch 4B is provided on the handle 4 for maintaining ON state of the switch 4A.

The base 7 has an upper surface 7A facing the main body 1, and a lower surface 7B adapted to face with the workpiece. The lower surface 7B is formed with a fluorine resin for improving slidability with respect to the workpiece. The base 7 is formed with a slot to allow the circular blade 5 to pass therethrough. A pivot shaft 8 is supported to the base 7, and a position-regulation portion 9 is provided on the base 7. The main body 1 has a front end portion pivotally movably connected to the base 7 by the pivot shaft 8, and a rear end portion provided with a movable shaft 9A.

Figure 5:
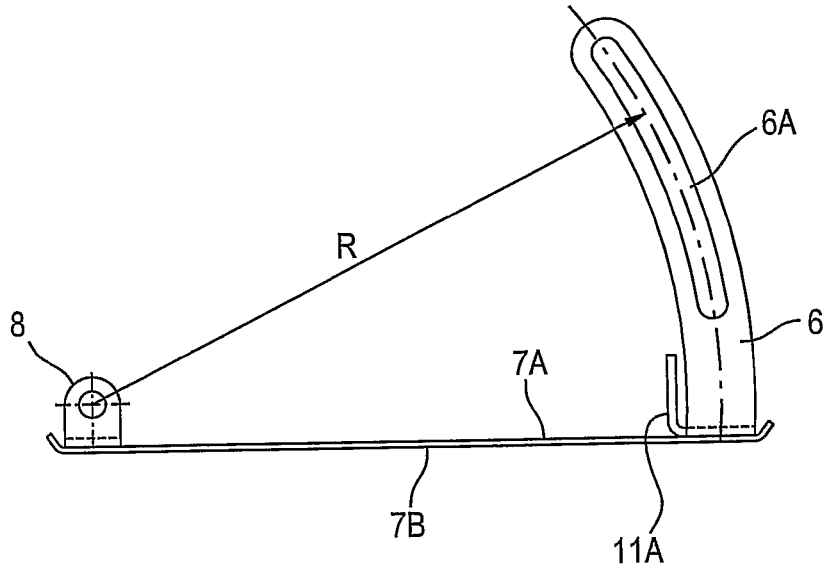
FIG. 5 is a front view of the link and a base in the electrically powered cutter according to the first embodiment.

The link 6 extends generally vertically from the upper surface 7A of the base 7. The link 6 is made from a metal, and is fixed thereto by welding. The link 6 has an arcuate guide slot 6A whose center of radius R is coincident with the pivot shaft 8 as shown in FIG. 5. The movable shaft 9A passes through the guide slot 6A and is movable within the stroke of the guide slot 6A. Upon movement of the movable shaft 9A within the guide slot 6A, a pivot posture of the main body 1 can be changed. Further, a desired pivot posture can be fixed by the position-regulation portion 9, thereby fixing a cutting depth of the circular blade 5.

A liquid ejector 10 such as a peacock is provided to the main body 1. The ejector 10 serves to eject liquid such as water to the circular blade 5 during cutting operation in order to reduce scattering of cutting dust and to reduce cutting resistance. The ejector 10 is connected to a hose 10A so that water can be supplied to the circular blade 5.

Figure 6:
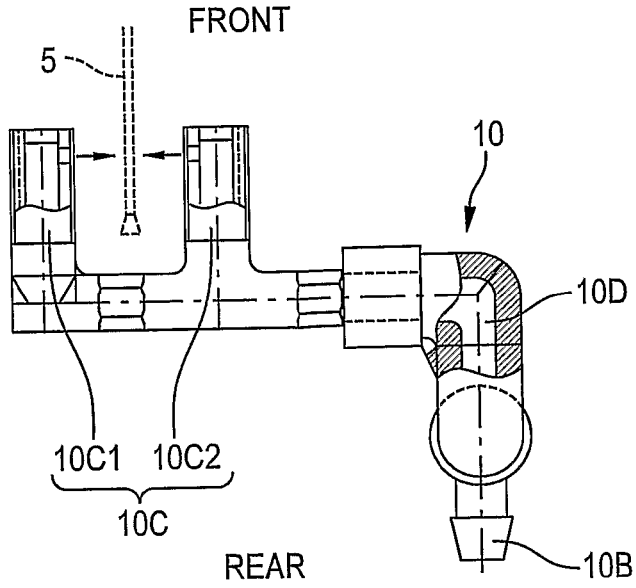
FIG. 6 is a plan view of a water ejector (peacock) in the electrically powered cutter according to the first embodiment.

The peacock 10 is best shown in FIG. 6. The peacock 10 includes a connecting portion 10B to which the hose 10A is connected, a conduit portion 10D, and a water ejecting portion 10C including a first ejecting part 10C1 and a second ejecting part 10C2 those branching from the conduit portion 10D. The circular saw blade 5 is positioned between the first and second ejecting parts 10C1 and 10C2. The first ejecting part 10C1 has a first ejection passage extending toward one planer side of the circular blade 5 (left side surface in FIG. 6), and the second ejecting part 10C2 has a second ejection passage extending toward another planer side of the circular blade 5 (right side surface in FIG. 10). Thus, water supplied through the hose 10A is introduced into the conduit 10D through the connecting portion 10B, and is discharged toward the side surfaces of the saw blade 5 from the first and second ejecting parts 10C1, 10C2 as shown by arrows in FIG. 6. Incidentally, water ejection is independent of ON switching operation of the switch 4A.

Figure 4:
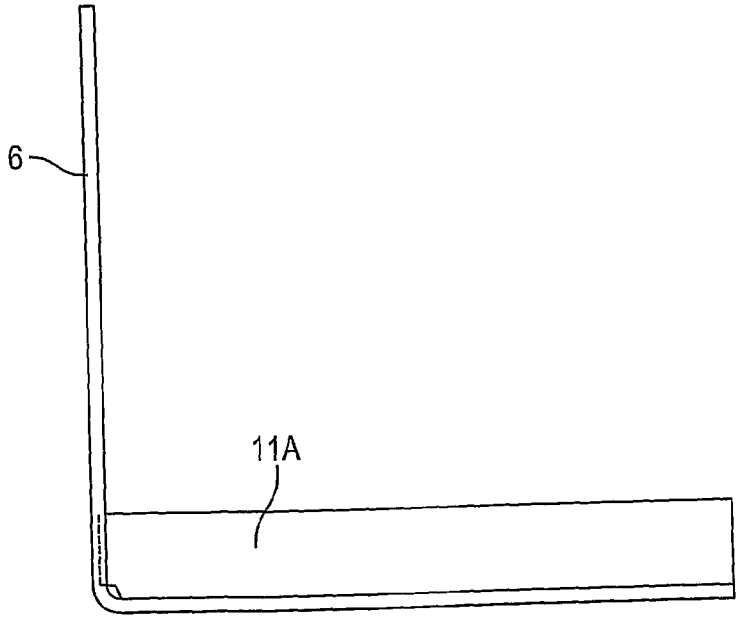
FIG. 4 is a right side view of a link in the electrically powered cutter according to the first embodiment.

As shown in FIGS. 4 and 5, the link 6 is integrally provided with a liquid splashboard section 11A positioned behind the circular blade 5 in the cutting direction. The splashboard section 11A projects upwardly in a direction perpendicular to the base 7 and extends in a direction parallel to the rotation shaft 5A of the circular blade 5. A width of the splashboard section 11A in the direction perpendicular to the cutting direction is approximately the same as the width of the base 7. A gently curved connecting portion is provided at a position adjacent to a connecting portion between the liquid splashboard section 11A and the base 7.

The liquid splashboard section 11A is positioned rearward of the air discharge port 2A in the cutting direction, Further, at least a part of the liquid splashboard section 11A is positioned in alignment with the air discharge port 2A in the cutting direction. Further, the splashboard section 11A is positioned adjacent to the side surfaces of the circular blade 5.

In operation, the electrically powered cutter is provided with a feeder circuit (not shown) to which an external power source or storage battery is connected. Upon turning ON the switch 4A and operating the ON-lock switch 4B, electrical power is supplied to the feeder circuit for energizing the motor 12, to thus rotate the motor shaft 12A and the fan 13. Upon rotation of the fan, air is introduced into the interior of the housing 2 through the air inlet to cool the motor 12, and is discharged outside through the discharge port 2A. The discharged air is blown rearward in the cutting direction, and is directed toward the upper surface 7A of the base 7.

Further, the rotation of the motor shaft 12A is transmitted to the rotation shaft 5A through the gear 5B to rotate the circular blade 5 in a clockwise direction in FIG. 1. At the same time, water is supplied into the peacock 10 through the hose 10A, so that the water is splashed rearward in the cutting direction by the rotation of the circular blade 5. However, since the splashed water is impinged on the splashboard section 11A, the splashboard section 11A can prevent the water from further splashing rearward from the board 11A in the cutting direction. Thus, the splashboard section 11A can enhance workability.

Further, water on the upper surface 7A of the base 7 is blown rearward in the cutting direction due to the air blowing from the air discharge port 2A. However, since the part of the splashboard section 11A is positioned rearward of the air discharge port 2A and in alignment therewith respect to the cutting direction, such splashed water is also shut off by the splashboard section 11A. In summary, the splashboard section 11A can shut off the water splashing rearward by the rotation of the circular blade 5 and by the air blowing from the air discharge port 2A. Furthermore, since the splashboard section 11A is integral with the link 6, attachment work of the link 6 and the splashboard section 11A to the base 7 can be facilitated. Moreover, since integral manufacture of the splashboard section 11A and the link 6 can be facilitated since these are formed by a metal plate.

Figure 7:
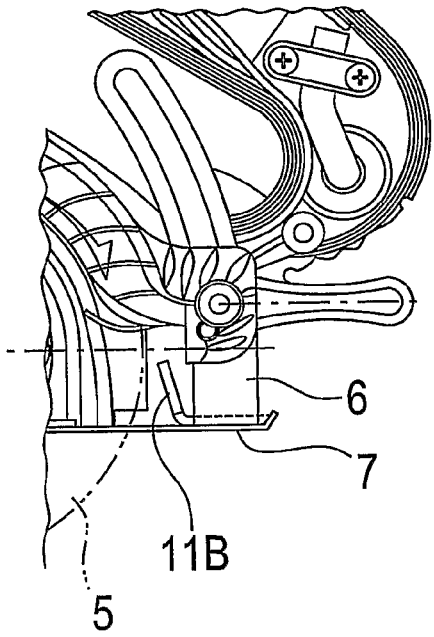
FIG. 7 is an enlarged partial front view particularly showing a liquid splashboard (splashguard) in an electrically powered cutter according to a second embodiment of the present invention.

A cutter according to a second embodiment of the present invention will be described with reference to FIG. 7. The second embodiment and subsequent embodiments are similar to the first embodiment except for a configuration of a splashboard section. A splashboard section 11B in the second embodiment is integral with the link 6 and at a position similar to that of the first embodiment. However, the splashboard section 11B is inclined toward the circular blade 5 at an acute angle such as about 60 degrees with respect to the base 7, so that a tip end of the splashboard section 11B is positioned closer to the circular saw blade 5 than its base end to the circular saw blade 5.

Provided that a vertical height of the splashboard 11B of the second embodiment is equal to that of the splashboard 11A of the first embodiment, the splashboard 11B can provide higher water shutting off performance because of the higher resistance against the motion of the splashed water moving rearward in the cutting direction by the rotation of the circular blade and by the air blowing from the air discharge port 2A.

Figure 8:
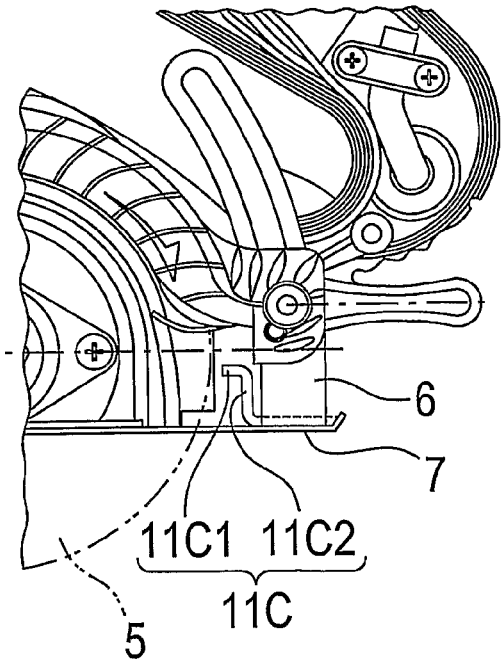
FIG. 8 is an enlarged partial front view particularly showing a liquid splashboard in an electrically powered cutter according to a third embodiment of the present invention.

FIG. 8 shows a cutter according to a third embodiment of the present invention. A splashboard section 11C in the third embodiment is integral with the link 6 and at a position similar to that of the first embodiment. However, the splashboard section 11C has a vertical base end portion 11C2 protruding in a direction perpendicular to the base 7 and a free end bent portion 11C1 horizontally protruding from the base end portion 11C2 in a direction parallel to the base 7.

With this arrangement, the vertical base end portion 11C2 provides a function the same as that in the splashboard 11A of the first embodiment. Further, the bent portion 11C1 can trap the splashed water directing upward. Thus, excellent splashguard function can be provided. This configuration is particularly advantageous when altering a cutting depth.

Figure 9:
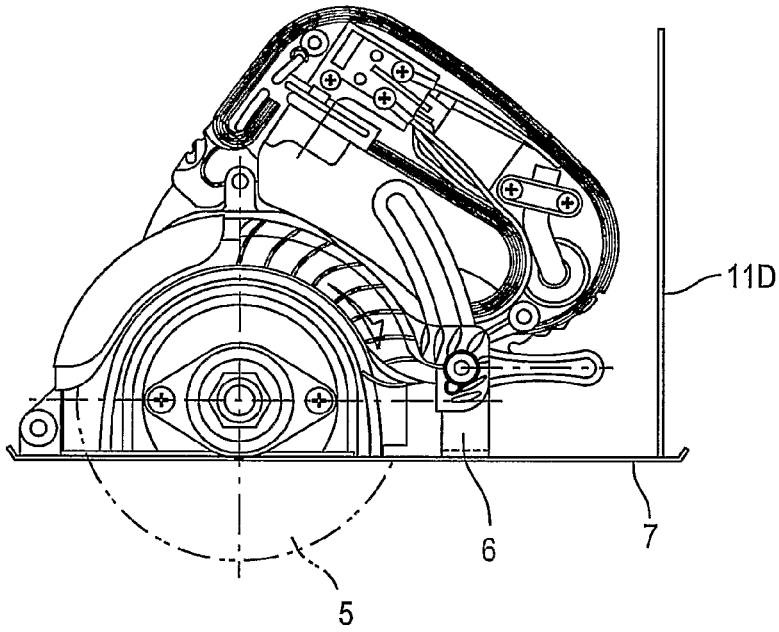
FIG. 9 is a front view particularly showing a liquid splashboard in an electrically powered cutter according to a fourth embodiment of the present invention.

FIG. 9 shows a cutter according to a fourth embodiment of the present invention. A part of the splashboard section 11D is aligned with the circular saw 5 in the cutting direction similar to the foregoing embodiment. However, the splashboard section 11D is positioned at a rearmost end portion of the base 7. Further, the splashboard section 11D is not integral with the link 6 but is connected to the rearmost end portion of the base 7 by welding and extends therefrom in a direction perpendicular to the base 7. An uppermost end of the splashboard section 11D is positioned higher than that of the link 6. Further, a width of the splashboard section 11D in the direction perpendicular to the cutting direction is approximately the same as the width of the base 7 similar to the first embodiment.

With this arrangement, liquid splashing directing rearward of the base 7 can be almost completely restrained by the splashboard section 11D, since height of the splashboard section 11D is greater than that of the link 6. Upon pivotal movement of the main body 1 about the pivot shaft 8 by way of guidance by the link 6, water may be splashed upwardly and rearwardly by the rotation of the circular blade 5. Even in this case, the splashboard section 11D can prevent the splashed water from being scattered rearward of the cutter. Further, assembleability of the cutter can be improved since the splashboard section 11D can be assembled to the base 7 independent of the assembly of the link 6 to the base 6.

Figure 10:
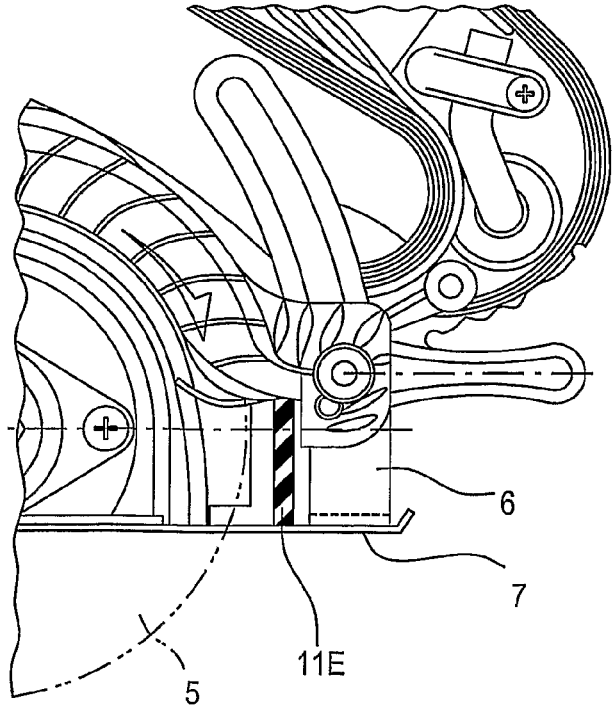
FIG. 10 is an enlarged partial front view particularly showing a liquid splashboard in an electrically powered cutter according to a fifth embodiment of the present invention.
Figure 11:
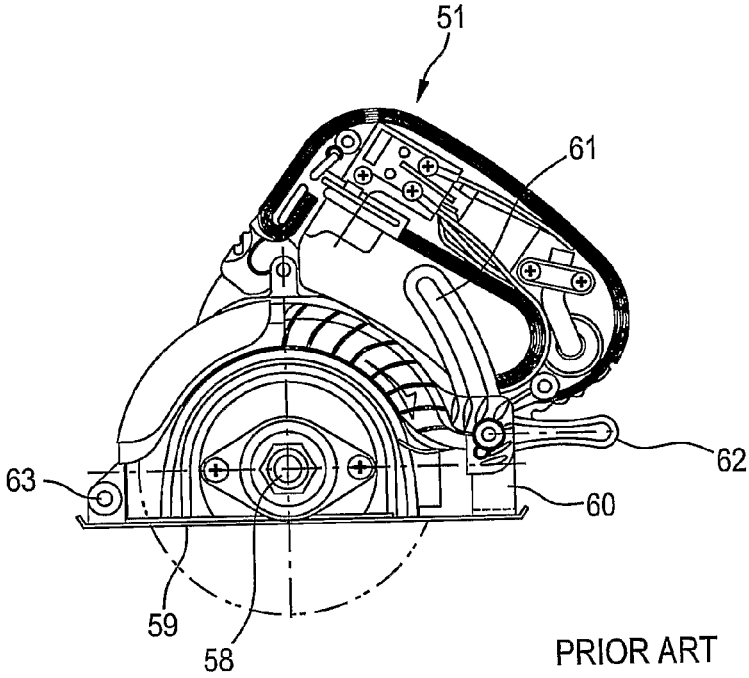
FIG. 11 is a front view of a conventional electrical stone cutter.
Figure 12:
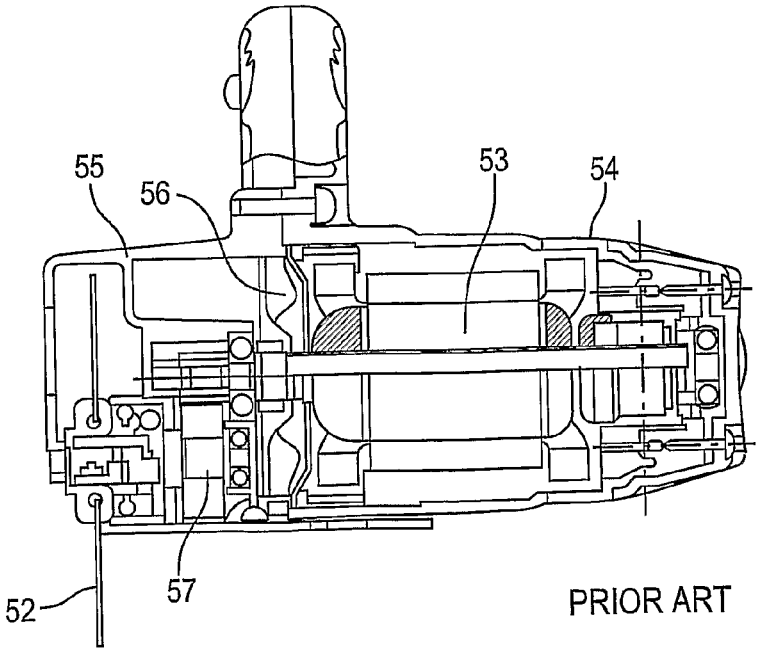
PRIOR ART FIG.12
FIG. 12 is a right side view with showing an internal arrangement of the conventional cutter of FIG. 11.

FIG. 10 shows a cutter according to a fifth embodiment of the present invention. In this embodiment, a splashboard section 11E is made from an elastic material such as a rubber, and protrudes from the base 7 in a direction perpendicular thereto. The splashboard section 11E has one end fixed to the base 7 and another end fixed to the main body 1. The splashboard section 11E is expandable and shrinkable in accordance with a pivotal movement of the main body 1 about the pivot shaft 8 in respect of the protruding direction.

Any impact due to collision of foreign object against the splashboard 11E can be moderated or dampened since the board 11E is made from elastic material. Further splashguard area can be increased when the splashboard 11E expands as a result of pivotal movement of the main body 1 about the pivot shaft 8. Thus, inadvertent scattering of the splashed water rearward of the base 7 can be restrained.

In the foregoing embodiments, width of the splash board section 11A to 11E in a direction perpendicular to the cutting direction is approximately the same as the width of the base 7. However, the width of the splash board section can be different from that of the base 7, as long as a part of the splash board section is aligned with the circular blade 5, i.e., aligned with side surfaces of the circular blade 5, and with the air discharge port 2A in the cutting direction.

Further, in the above-described embodiment, the ejector (peacock) 10 is attached to the main body 1 for supplying liquid to the surface of the circular blade 5. However, independent liquid supplying device can be provided instead of the peacock 10 for supplying water during cutting operation. Alternatively, liquid supplying device can be dispensed with. In the latter case, provisional water application to the surface of the workpiece may be performed.

Further, in the above-described embodiment, the ejector 10 is adapted to eject water to the circular blade 5. However, the ejector ejecting water to the workpiece is also available in the present invention.

While the invention has been described in detail and with reference to specific embodiments thereof, it would be apparent to those skilled in the art that various changes and modification may be made therein without departing from the scope of the invention.

INDUSTRIAL APPLICABILITY

The cutter according to the invention is particularly available for cutting workpiece such as a stone in a narrow working spot.

The invention claimed is:

1. A handheld cutter for cutting a workpiece during sliding movement of the handheld cutter relative to the workpiece while using a water comprising:

a housing comprising a handle;

an electric motor disposed in the housing;

a rotation shaft supported by the housing for rotatably supporting an end tool driven by the electric motor;

a base supporting the housing, and having a top surface and a bottom surface to be in contact with the workpiece, the end tool having a part being protrudable from the bottom surface;

a splashboard section positioned on the top surface and behind the end tool in the sliding direction, the splashboard section protruding in a direction away from the top surface and extending in a direction substantially parallel to an axial direction of the rotation shaft; and a link extending from the upper surface of the base;

wherein the housing has a front end portion in the sliding direction pivotally movably connected to the base, and has a rear end portion in the sliding direction; and wherein the end tool is a circular blade;

wherein the rear end portion of the housing is releasably fixable to the link to maintain a pivot posture of the housing, and wherein the splashboard section is integral with the link.

2. The cutter as claimed in claim 1, further comprising a fan disposed in the housing and rotatably driven by the electric motor for cooling the electric motor;

wherein the housing is formed with an air discharge port open to an atmosphere for discharging an air flowing in the housing to the atmosphere; and wherein the splashboard section is positioned rearward of the air discharge port in the sliding direction, and has a part aligned with the air discharge port in the sliding direction.

3. The cutter as claimed in claim 1, wherein the splashboard section is inclined toward the circular blade so that a tip end of the splashboard section is positioned closer to the circular blade than its base end to the circular blade.

4. The cutter as claimed in claim 1, wherein the splashboard section has a base end portion protruding in a direction perpendicular to the base, and a free end portion bent from the base end portion and oriented toward the circular blade.

5. The cutter as claimed in claim 1, further comprising a liquid ejection unit having a liquid inlet and a liquid outlet for ejecting liquid toward one of the circular blade and the workpiece.

* * * * *